US012551015B2

(12) United States Patent
Lu

(10) Patent No.: US 12,551,015 B2
(45) Date of Patent: Feb. 17, 2026

(54) SOFA

(71) Applicant: AuGroup technology Co., Ltd., Shenzhen (CN)

(72) Inventor: Haichuan Lu, Shenzhen (CN)

(73) Assignee: AuGroup Technology Co., Ltd., Shenzhen (CN)

( * ) Notice: Subject to any disclaimer, the term of this patent is extended or adjusted under 35 U.S.C. 154(b) by 166 days.

(21) Appl. No.: 18/673,249

(22) Filed: May 23, 2024

(65) Prior Publication Data

US 2025/0248524 A1 Aug. 7, 2025

(30) Foreign Application Priority Data

Feb. 5, 2024 (CN) ..... 202410170480.X

(51) Int. Cl.
*A47C 4/02* (2006.01)
*A47C 17/02* (2006.01)
*A47C 7/62* (2006.01)

(52) U.S. Cl.
CPC ..... *A47C 4/028* (2013.01); *A47C 17/02* (2013.01); *A47C 7/626* (2018.08)

(58) Field of Classification Search
CPC ..... A47C 4/028; A47C 17/02; A47C 17/86; A47C 17/04; A47C 7/626; A47C 31/023; A47C 13/005
See application file for complete search history.

(56) References Cited

U.S. PATENT DOCUMENTS 3,700,282 A * 10/1972 Rowland ..... A47C 7/20 297/228.1
3,747,977 A * 7/1973 Rowland ..... A47C 11/005 297/452.57
3,751,107 A * 8/1973 Greitzer ..... A47C 4/02 297/440.2
4,828,324 A * 5/1989 Putnam ..... F16B 9/058 403/189
11,607,044 B2 * 3/2023 Brandtner ..... A47C 1/02
11,696,644 B2 * 7/2023 Brandtner ..... A47C 31/02 297/440.23
2010/0148563 A1 * 6/2010 Fera ..... A47C 17/86 297/463.1
2010/0270844 A1 * 10/2010 Hood ..... A47C 7/42 297/440.15
2012/0217784 A1 * 8/2012 Griggs, Jr. ..... A47C 4/028 297/440.1
2019/0254440 A1 * 8/2019 Gates ..... A47C 17/02
2020/0029699 A1 * 1/2020 Brandtner ..... A47C 31/02
2021/0169235 A1 * 6/2021 Svensson ..... A47C 4/028
2021/0289941 A1 * 9/2021 Brandtner ..... A47C 7/52
2022/0346561 A1 * 11/2022 Wang ..... A47C 4/028
2024/0148148 A1 * 5/2024 Shao ..... A47C 4/028
2024/0148151 A1 * 5/2024 Andersson ..... A47C 17/26
2025/0160523 A1 * 5/2025 Milberg ..... A47C 4/021

FOREIGN PATENT DOCUMENTS

CN 117860071 A * 4/2024 ..... A47C 31/023

* cited by examiner

*Primary Examiner* — William L Miller

(57) ABSTRACT

A sofa includes: a base; a backrest assembly including a backrest frame having a front side and a rear side, and a first flexible sheet. The backrest frame is directly or indirectly connected to the base. The backrest frame has a lower end spaced a distance from the base. The first flexible sheet is connected to the front side of the backrest frame and extends from the backrest frame to and detachably connected to the base.

10 Claims, 7 Drawing Sheets

SOFA

CROSS REFERENCE TO RELATED APPLICATIONS

This application claims priority to Chinese Patent Application No. CN 202410170480.X, filed Feb. 5, 2024, which is hereby incorporated by reference herein as if set forth in its entirety.

TECHNICAL FIELD

The present disclosure generally relates to furniture, and in particular relates to a sofa.

BACKGROUND

Sofas usually include bases, backrest assemblies and armrest assemblies. The components of some sofas can be manufactured separately and then transported to a designated location before being assembled. The structure of a sofa may have an impact on the cost. How to reduce the cost without affecting the normal use has become an important issue.

BRIEF DESCRIPTION OF DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
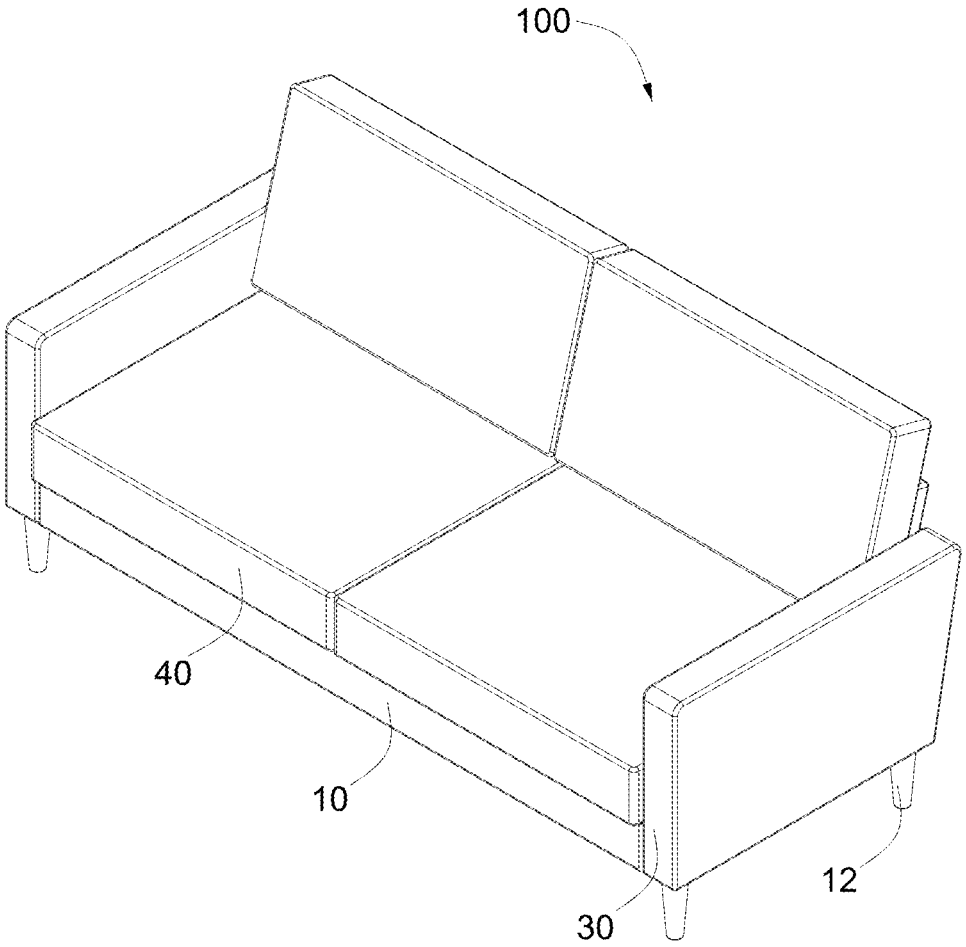
FIG. 1 is a perspective view of a sofa according to one embodiment.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

Figure 2:
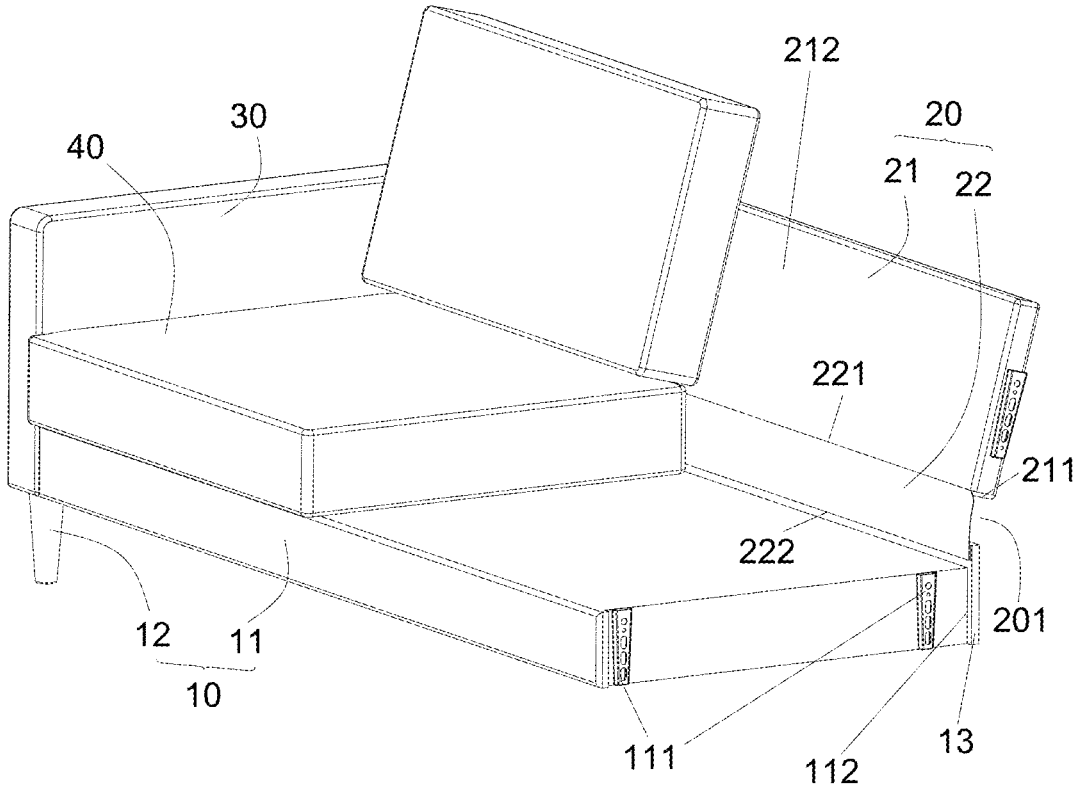
FIG. 2 is another perspective view of the sofa with some components omitted for clarity.
Figure 3:
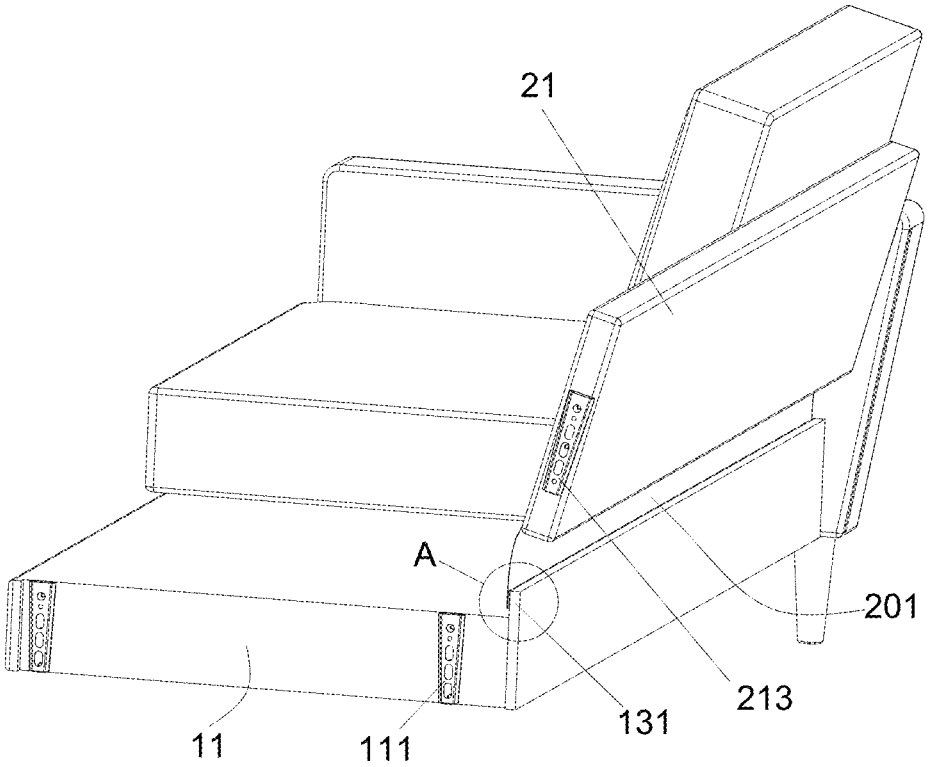
FIG. 3 is another perspective view of the sofa with some components omitted for clarity.

Referring to FIGS. 1 to 3, in one embodiment, a sofa 100 may include a base 10 and a backrest assembly 20. The backrest assembly 20 may include a backrest frame 21 and a first flexible sheet 22. The backrest frame 21 can be directly or indirectly connected to the base 10. The lower end 211 of the backrest frame 21 is spaced apart from the base 20 by a certain distance. The first flexible sheet 22 is connected to the front side 212 of the backrest frame 21 and extends from the backrest frame 21 to and detachably connected to the base 10.

With such configuration, material usage during the sofa manufacturing phase can be reduced, and overall weight can be decreased for transportation purposes. The backrest frame 21 is spaced apart from the base 20, allowing users to comfortably lean against the backrest frame 21. Additionally, compared to conventional backrests directly attached to the base, backrest frame 21 has a lower height, which helps reduce costs.

The base 10 may include a main body 11 and legs 12. The main body 11 is generally a flat cuboid. The number of the legs 12 may be four. The legs 12 are connected to the four corners of the main body 11.

Figure 7:
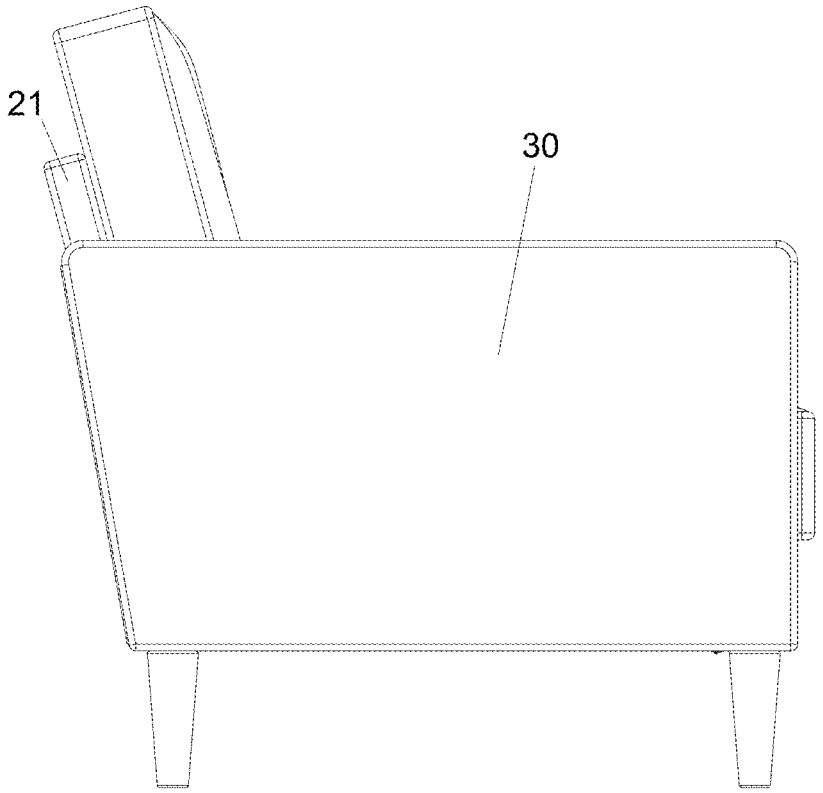
FIG. 7 is a side view of the sofa according to one embodiment.

In one embodiment, the sofa 100 may further include two armrest assemblies 30 that are detachably connected to the base 10. The backrest frame 21 is detachably connected to the armrest assemblies 30. Specifically, the armrest assemblies 30 are both cuboid and are respectively connected to the left end and the right end of the main body 11. For example, one or more connecting members 111 are provided on both the left and right ends of the main body 11, and the armrest assemblies 30 are detachably connected to the base 10 through the connecting members 111. It can be understood that the shape of the armrest assemblies 30 can be selected as needed. For example, referring to FIG. 7, the backrest frame 21 may be inclined relative to the base 10. In order to match the inclined backrest frame 21, the rear end surface of each armrest assembly 30 close to the backrest frame 21 may be inclined.

Since the armrest assemblies 30 are detachably connected to the base 10, and the backrest frame 21 is detachably connected to the armrest assemblies 30, the backrest frame 21 is indirectly connected to the base 10 through the armrest assemblies 30. For example, two connecting members 213 (see FIG. 3) are provided on opposite ends of the backrest frame 21. Through the connecting members 213, the backrest frame 21 is detachably connected to the armrest assemblies 30. In one embodiment, the connecting members 213 may be of the same structure as the connecting members 111. It is understood that in other embodiments, the base 10 may include a backrest mounting portion extending along a vertical direction or substantially along a vertical direction or at any angle within a range of 1° to 30° from the vertical direction. The backrest frame 21 can be directly mounted on the backrest mounting portion.

The backrest frame 21 is generally a flat cuboid with the same or substantially the same length as the main body 11. The left and right ends of the backrest frame 21 are flush with the left and right ends of the main body 11, respectively. The backrest frame 21 is located close to the rear end 112 of the main body 11. The lower end 211 of the backrest frame 21 and the base 10 define a hollow space 201 in the vertical direction.

Figure 4:
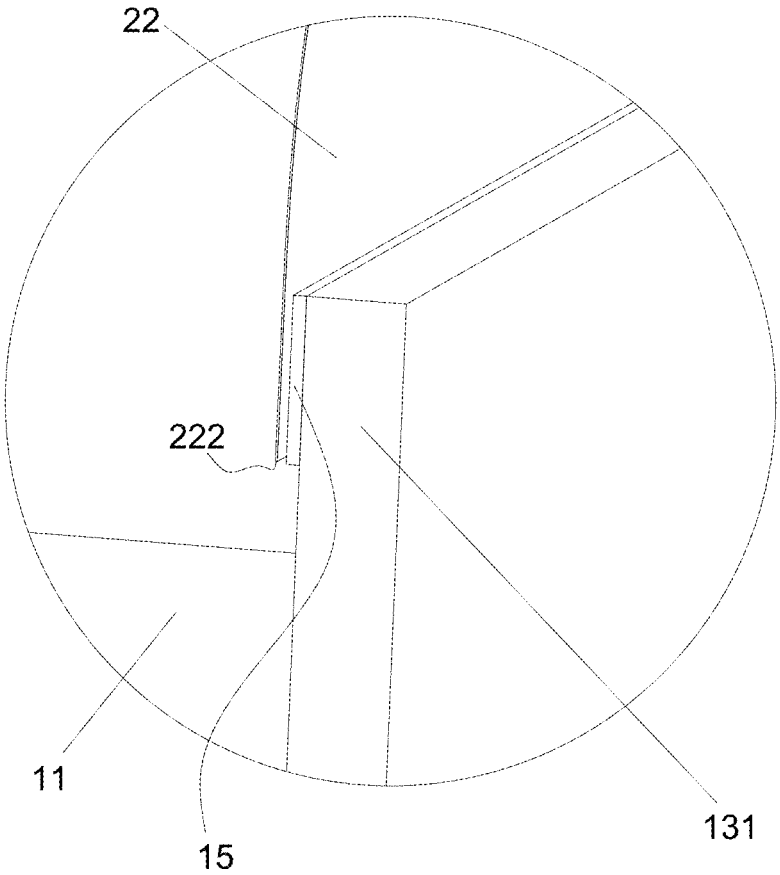
FIG. 4 is an enlarged view of a portion A of FIG. 3.

In one embodiment, the base 10 may further include a back panel 13 connected to the rear end 112 of the main body 11. The back panel 13 includes an upper portion 131 higher than the main body 11, and the first flexible sheet 22 is connected to the upper portion 13. In one embodiment, the lower end 211 of the first flexible sheet 22 can be detachably connected to the upper portion 131 through a zipper or hook-and-loop fastener 15 (see FIG. 4).

In one embodiment, the sofa 100 may further include a seat cushion 40 placed on the main body 11 of the base 10. The rear end of the seat cushion 40 abuts against the upper portion 131 and is adjacent to the hollow space 201. Due to the obstruction caused by the upper portion 131, the seat cushion 40 will not move towards the hollow space 201 when subjected to external force from the user.

The thickness of the seat cushion 40 can be determined based on the height of the hollow space 201. Specifically, the thickness of the seat cushion 40 can be equal to or slightly greater than the height of the hollow space 201.

In one embodiment, the first flexible sheet 22 has approximately the same length as the backrest frame 21, and the first flexible sheet 22 can be made of flexible materials such as cloth or leather. The first flexible sheet 22 can be integrally formed with the backrest frame 21, or can be detachably connected to the backrest frame 21 using a zipper or hook-and-loop fastener as needed. When the upper end 221 of the first flexible sheet 22 is connected to the backrest frame 21 and the lower end 222 of the first flexible sheet 22 is connected to the base 10, the first flexible sheet 22 covers the hollow space 201 from the front side 212 of the backrest frame 21. The first flexible sheet 22 and the front side 212 of the backrest frame 21 have the same or similar color, allowing them to form a resting surface that visually appears as a seamless plane.

Although the first flexible sheet 22 covers the hollow space 201 from the front side 212 of the backrest frame 21, users can still see the hollow space 201 from the rear side 214 of the backrest frame 21. In this case, the sofa 100 can be placed against a wall, ensuring that the hollow space 201 is not visible to users and thus does not detract from the aesthetic appeal of the sofa 100.

Figure 5:
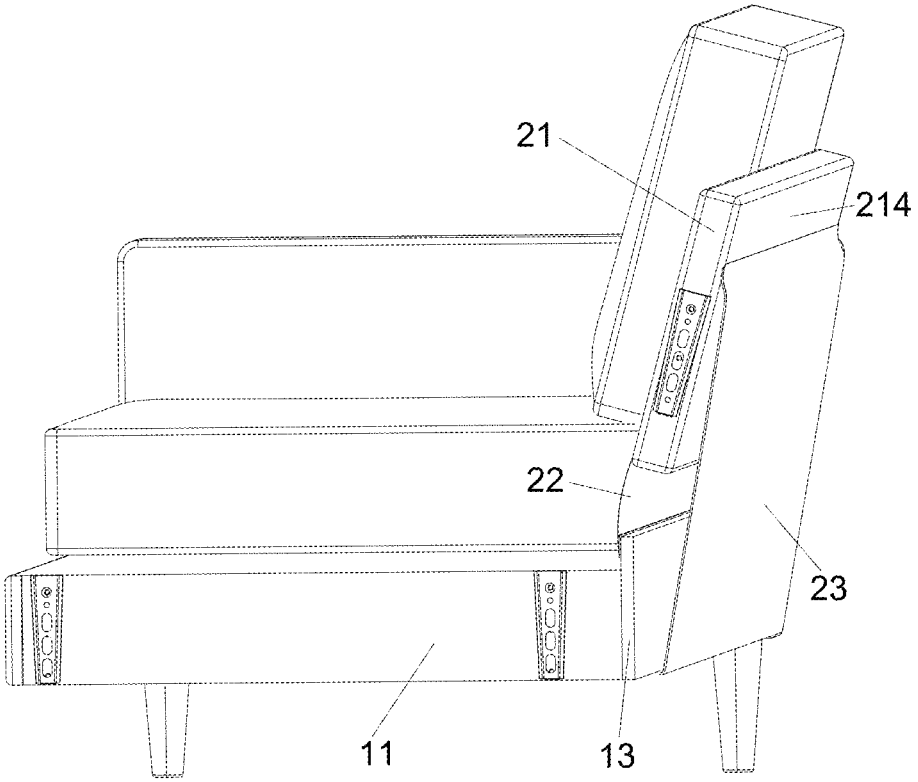
FIG. 5 is another perspective view of the sofa with some components omitted and a second flexible sheet attached to the rear side of the backrest frame.

Referring to FIG. 5, in one embodiment, the backrest assembly 20 may further include a second flexible sheet 23. The second flexible sheet 23 is connected to the rear side 214 of the backrest frame 21 and extends from the backrest frame 21 to and detachably connected to the base 10. The second flexible sheet 23 can be made of flexible materials such as cloth or leather. The second flexible sheet 23 can be integrally formed with the backrest frame 21, or can be detachably connected to the backrest frame 21 using a zipper or hook-and-loop fastener as needed. When the upper end of the second flexible sheet 23 is connected to the backrest frame 21 and the lower end of the second flexible sheet 23 is connected to the base 10, the second flexible sheet 23 covers the hollow space 201 from the rear side 214 of the backrest frame 21. The second flexible sheet 23 and the rear side 214 of the backrest frame 21 have the same or similar color, allowing them to form a surface that visually appears as a seamless plane.

Figure 6:
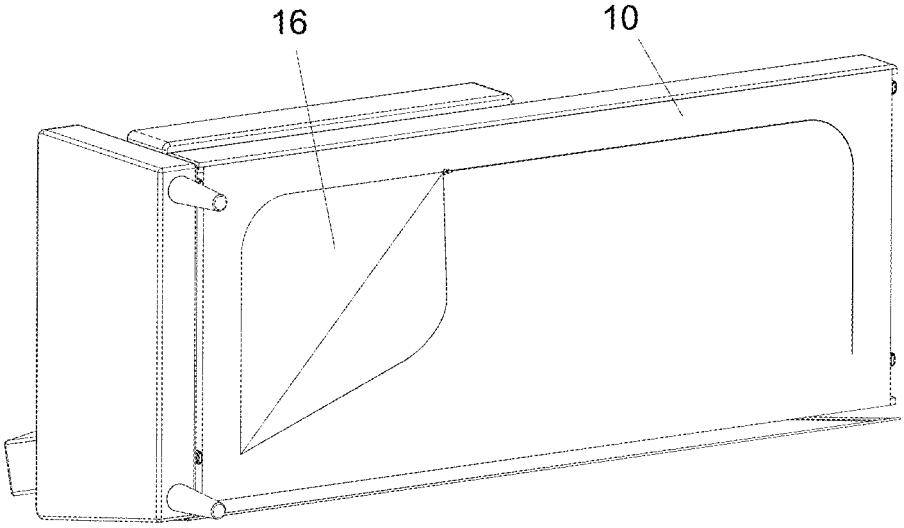
FIG. 6 is another perspective view of the sofa showing the bottom thereof.

Referring to FIG. 6, in one embodiment, in order to facilitate transportation, a receiving chamber 16 is provided at the bottom of the main body 11 of the base 10. During packaging and transportation, some components can be put into the receiving chamber 16 to prevent the loss of these components. The receiving chamber 16 has an opening, and the opening can be covered by a flexible cover. The flexible cover can be connected to the base 10 through a zipper or hook-and-loop fastener.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A sofa comprising:

a base;

a backrest assembly comprising a backrest frame having a front side and a rear side, and a first flexible sheet, the backrest frame directly or indirectly connected to the base, the backrest frame comprising a lower end spaced a distance from the base, the first flexible sheet connected to the front side of the backrest frame and extending from the backrest frame to and detachably connected to the base.

2. The sofa of claim 1, wherein the backrest assembly further comprises a second flexible sheet connected to the rear side of the backrest frame and extending from the backrest frame to and detachably connected to the base.

3. The sofa of claim 1, further comprising an armrest assembly, wherein the armrest assembly is detachably connected to the base, and the backrest frame is detachably connected to the armrest assembly.

4. The sofa of claim 1, wherein the base comprise a main body and a back panel connected to a rear end of the main body, the back panel comprises an upper portion higher than the main body, and the first flexible sheet is attached to the upper portion.

5. The sofa of claim 4, wherein the first flexible sheet is detachably connected to the upper portion through a zipper or a hook-and-loop fastener.

6. A sofa comprising:

a base;

a backrest frame directly or indirectly connected to the base, the backrest frame comprising a lower end, the lower end and the base defining a hollow space in a vertical direction; and a first flexible sheet comprising an upper end and a lower end, the upper end connected to the backrest frame, the lower end detachably connected to the base, wherein the first flexible sheet is configured to cover the hollow space.

7. The sofa of claim 6, further comprising a second flexible sheet connected to a rear side of the backrest frame and extending from the backrest frame to and detachably connected to the base, wherein the first flexible sheet is connected to a front side of the backrest frame.

8. The sofa of claim 6, further comprising an armrest assembly, wherein the armrest assembly is detachably connected to the base, and the backrest frame is detachably connected to the armrest assembly.

9. The sofa of claim 6, wherein the base comprise a main body and a back panel connected to a rear end of the main body, the back panel comprises an upper portion higher than the main body, and the first flexible sheet is attached to the upper portion.

10. A sofa comprising:

a base;

an arm assembly detachably connected to the base; and a backrest assembly comprising a backrest frame and a first flexible sheet, the backrest frame detachably connected to the arm assembly, the backrest frame comprising a lower end, the lower end of the backrest frame and the base defining a hollow space in a vertical direction, the first flexible sheet comprising an upper end and a lower end, the upper end of the first flexible sheet connected to the backrest frame, the lower end of the first flexible sheet detachably connected to the base, and the first flexible sheet configured to cover the hollow space.

* * * * *